US005155875A

United States Patent [19]

Kirkkala et al.

[11] Patent Number: 5,155,875

[45] Date of Patent: Oct. 20, 1992

[54] BRUSH ROLLER AND ITS BRUSH ELEMENT

[75] Inventors: Mauno Kirkkala, Länkipohja; Reijo Kuivikko, Tampere, both of Finland

[73] Assignee: Oy C. E. Lindgren AB, Porvoo, Finland

[21] Appl. No.: 583,797

[22] Filed: Sep. 17, 1990

[30] Foreign Application Priority Data

Sep. 18, 1989 [FI] Finland ..... 894378
Mar. 16, 1990 [FI] Finland ..... 901314

[51] Int. Cl.[5] ..... A46B 3/02; A46B 7/10

[52] U.S. Cl. ..... 15/183; 15/193; 15/195; 15/199; 300/21

[58] Field of Search ..... 15/179–183, 15/186, 54, 55, 159 A, 176.5, 190–193, 195, 198, 199, 200, 71–73, 23, 159 R; 300/21; 29/110, 120, 121.1–121.3, 121.5, 125

[56] References Cited

U.S. PATENT DOCUMENTS

| | | | |
|---|---|---|---|
| 951,432 | 3/1910 | Bowditch | 15/190 X |
| 1,398,035 | 11/1921 | Morrison | 15/193 X |
| 1,405,938 | 2/1922 | Rasmesen, Jr. | 300/21 X |
| 1,949,665 | 3/1934 | Stugis | 300/21 |
| 2,450,679 | 10/1948 | May | 15/183 X |
| 2,790,986 | 5/1957 | Schwartz et al. | 15/159 R |
| 2,879,534 | 3/1959 | Swanson et al. | 15/179 |
| 2,978,726 | 4/1961 | Park | 29/121.5 X |
| 3,120,671 | 2/1964 | Miller . | |
| 3,139,641 | 7/1964 | Grogan et al. | 15/179 X |
| 3,200,430 | 8/1965 | Haracz | 15/183 |
| 3,225,374 | 12/1965 | Daley et al. . | |
| 3,533,125 | 10/1970 | Buechel et al. . | |
| 3,715,773 | 2/1973 | Drumm . | |
| 4,214,346 | 7/1980 | McDonald | 15/183 X |
| 4,498,210 | 2/1985 | Drumm | 15/183 |
| 4,627,127 | 12/1986 | Dupre | 15/182 X |

FOREIGN PATENT DOCUMENTS

| | | | |
|---|---|---|---|
| 862308 | 1/1953 | Fed. Rep. of Germany . | |
| 921985 | 1/1955 | Fed. Rep. of Germany . | |
| 1057565 | 5/1959 | Fed. Rep. of Germany . | |
| 1956004 | 5/1971 | Fed. Rep. of Germany . | |
| 2329597 | 1/1975 | Fed. Rep. of Germany . | |
| 791045 | 12/1935 | France | 29/121.2 |
| 376472 | 5/1964 | Switzerland . | |
| 425514 | 5/1967 | Switzerland | 15/179 |
| 196724 | 5/1923 | United Kingdom | 15/179 |

*Primary Examiner*—Harvey C. Hornsby
*Assistant Examiner*—C. Cooley
*Attorney, Agent, or Firm*—Brooks & Kishman

[57] ABSTRACT

A brush roller (1) includes a cylinder section (2) and brush elements (4) attached to it. In each element (4) the bristles (6) are attached in essentially a radial direction. The cylinder (2) of the brush roller (1) includes longitudinal rails (3), and each element (4) includes an indentation (7), which attaches the element (4) to the rail (3), and one or more elements (4) are sequentially arranged to be pushed onto each rail (3).

1 Claim, 4 Drawing Sheets

BRUSH ROLLER AND ITS BRUSH ELEMENT

TECHNICAL FIELD

This invention relates to rotating brushes and more particularly to a brush roller and its brush element for glazing cardboard wherein the roller consists of a cylinder section having brush elements attached to it and in each element the brushes are attached essentially in a radial direction.

BACKGROUND ART

Modern cardboard glazing brushes are manufactured in such a way that a steel cylinder, revolving on bearings at its ends, and with a length of 1500–10,000 mm, acts as a frame section for the brush roller. This cylindrical brush roller weighs 400–4000 kg, depending on its construction. The frame section of the brush roller is covered with plates made from about 10 mm thick aluminum, the width of which is about 100 mm, and the length 1000 mm. The plates, which are bent to the form of the outer surface of the cylinder, are secured with screws in rows to the surface of the roller brush. Holes with a diameter of about 5 mm are drilled in the aluminum at about 10 mm centers, and horsehairs from a horse's mane, with a length of about 60 mm from the surface of the aluminum plate, are attached to the hole by the traditional hand-binding method. The aluminum plates made in this way are first brushed with thin glue on the underside, which partly penetrates the fibers in the drilled holes, binding the individual fibers to one another. In addition, the underside of the plates is brushed with a thick layer of polyurethane, which prevents the brush from unravelling if the binding wire breaks. This method, which is in use at present, is, however, a quite expensive and slow method of manufacture, due to the large amount of handwork. A brush roller that must be sent for re-brushing must first of all be removed from the cardboard machine and sent to a brush factory. There the aluminum plates are removed from the roller brush and the polyurethane on the underside of the aluminum plates is either dissolved or ground away, after which the remaining fibers are twisted out of the holes and the holes in the aluminum plate are individually drilled olean before re-binding. There are 40,000–120,000 holes in a single roller brush, depending on its size. After binding and re-gluing, the plates are once again attached to the surface of the roller brush and the uneven ends of the fibers remaining from hand binding are levelled to their correct length and the roller brush is balanced before being returned to the cardboard mill. Due to this time-consuming re-brushing cardboard mills have had to keep extra brush rollers, because some of the rollers must always be re-brushed. The long delivery dates have also been a great problem.

DISCLOSURE OF INVENTION

The object of this invention is to create a brush roller system, in which the brush rollers need no longer be removed from the machine, but new throw-away brush elements can be changed quickly in the cardboard machine. Extra brush rollers are then no longer required, neither are expensive return freight charges, nor the re-balancing of the roller. Cardboard mills can maintain a store of the throw-away brush elements in accordance with the invention, which take up little space, in which case problematic situations due to delays in deliveries will no longer arise.

A brush roller for the glazing of cardboard includes a cylinder section having brush elements attached to it. Each element has bristles that are attached in essentially a radial direction. The cylinder of the brush roller includes longitudinal rails or guides and each element includes an indentation that secures the element to the rail. Each rail is arranged so that one or several elements can be pushed onto it in sequence.

Each brush element includes a frame section, bristles and an attachment section. Several holes are formed in the base surface of the frame section into which the bunched and bent bristles are placed to thereby extend essentially through the base section. The other side includes a cast component which secures the ends of the tufts to the element. A securing section includes an indentation to attach the element to the guide which runs in the direction of an axle.

Preferably, the indentation is formed in an aluminum, the opposite side of which includes gripping lugs formed in the cast component. Herein the indentation surface of the aluminum section that forms the indentation includes a Teflon surface. The edges of the brush element in the direction of the guide are parallel and angled in such a way that two adjacent elements about each other and the brush elements provide complete brush coverage about the roll.

In the preferred embodiment, the tufts of the bristles include U-shaped staples by means of which the tufts are bent and pushed through the holes formed in the base surface of the frame section when the U-shaped staples remain inside the cast component.

In an alternative embodiment of the invention, the brush element includes a frame section including a hollow on the bristle side into which pre-stress bristles are set as a unified tuft sunk into the cast component that is set on the base.

The objects, features and advantages of the present invention are readily apparent from the following detailed description of the best mode for carrying out the invention when taken in connection with the accompanying drawings.

BEST MODE FOR CARRYING OUT THE INVENTION

Figure 1:
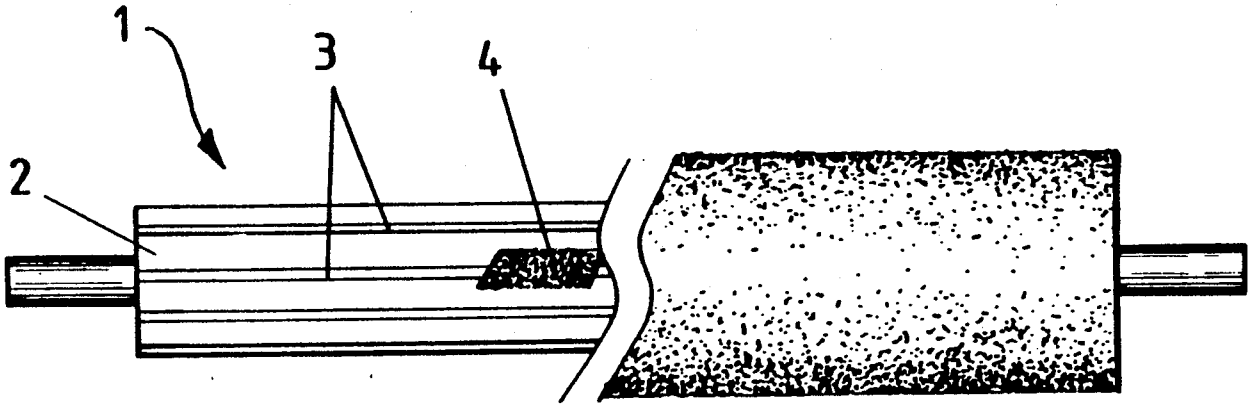
FIG. 1 illustrates a partially sectioned view of the brush roller constructed in accordance with the present invention.

In FIG. 1, one side of the brush roller 1 is shown without the brush elements 4. Only one brush element 4 is drawn on the left-hand side of the brush roller 1. The brush roller 1 includes guides 3, or slide rails, attached to the surface of its cylinder 2. In terms of the profile surface, these can be in other ways arbitrary, but they must be able to grip an indentation in the brush element 4.

The ends of the elements 4 are slanted in the direction of the rail, in which case the transfer point is made movable.

Figure 2:
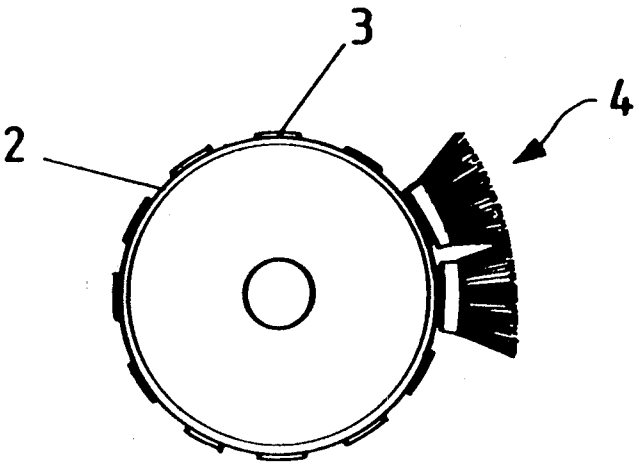
FIG. 2 illustrates a cross-sectional view of the brush roller of FIG. 1.
Figure 3:
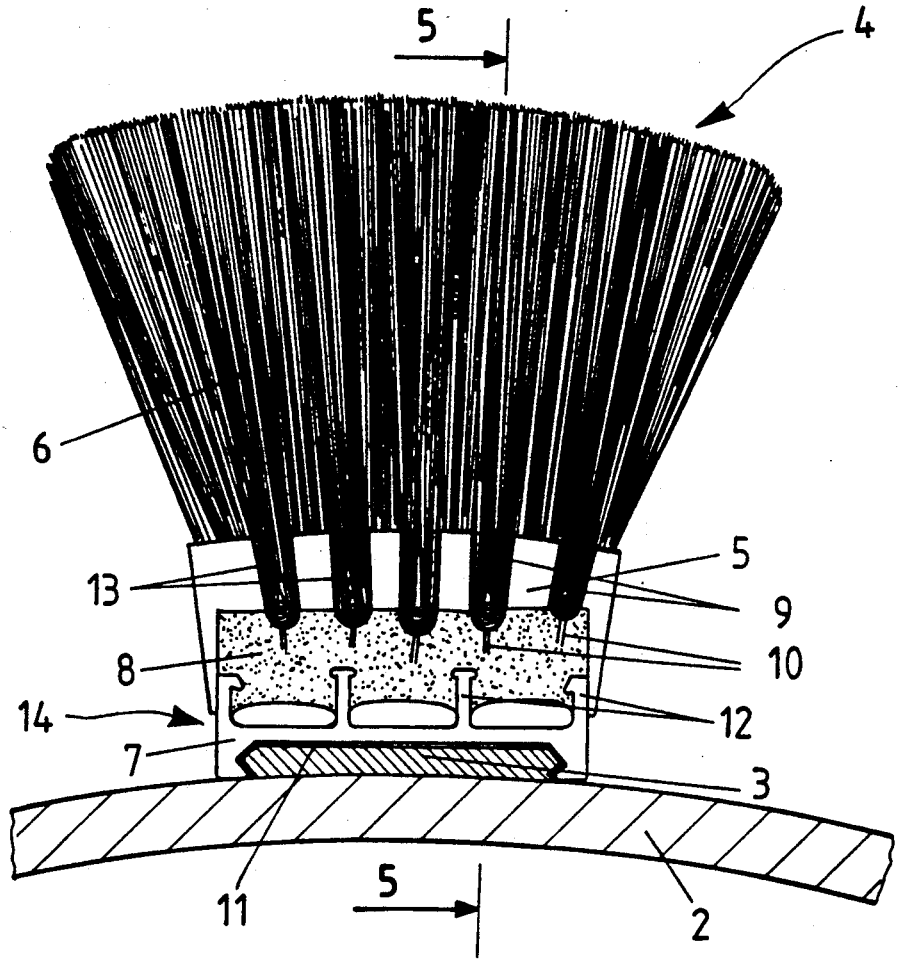
FIG. 3 illustrates an enlarged cross-sectional view of a part of the brush roller and a brush element mounted therein.

In FIG. 2, two brush elements 4 are attached to the guides 3, whereas the other guides 3 are without brush elements. A sufficient number of guides 3 is attached to the cylinder 2, so that the entire circumference is covered with brush elements.

In FIGS. 3 through 6*a*–6*f*, the structure of the brush element 4 is shown. The brush element 4 is constructed on a hard plastic frame 5. The base of the frame 5 is drilled densely with holes 13, from which the bunches of bristles 6 are pushed through as best seen in FIG. 6*c*. The bunches are brought through in such a way that a U-shaped staple 10 is formed in the bend 9 in the bunches FIG. 6*d*, the head of which very slightly protrudes from hole 13. The staples 10 protrude almost in their entirety after this casting mastic 8, which here is most advantageously formed by polyurethane-base resin, is poured into the trough formed by the frame 5, FIG. 6*d*. The viscosity of this should be suitable, so that it is absorbed by the brush fibers up to the thickness of the base section. The cast resin is poured nearly to the level of the outer surface of the edge section of the brush frame and before the resin hardens, an aluminum securing section 14 is sunk into it FIGS. 6*e* and 6*f*. Securing section 14 includes an indentation 7 and protruding grips 12. Grips 12 become firmly attached to the hardening cast mastic 8.

In practical experiments, it has been noted that a suitable sealing strip 11 is necessary between the aluminum counterparts, the indentation 7 and the rail 3. This both takes up the gap and prevents mechanical damage when the elements 4 are being pushed into place. In this respect, teflon tape has been found to be the most advantageous sealant.

An automatic machine can be used to place the tufts formed of the above mentioned bristles 6 into the perforated frame section. The method of manufacture deviates, however, from the known method of attaching bristles 6 in that here the hole is drilled through the piece, whereas in a normal brush frame the hole does not extend through the frame section, so that a staple that bends and collects the tuft can be fired into the brush frame.

Nearly three times the amount of brush bristles can be attached to the same surface area of a brush element 4 in accordance with the invention when compared to a brush made by hand-binding. The glazing characteristics and useful life of the glazing brush have been shown to improve in direct relation to the number of bristles used.

Figure 4:
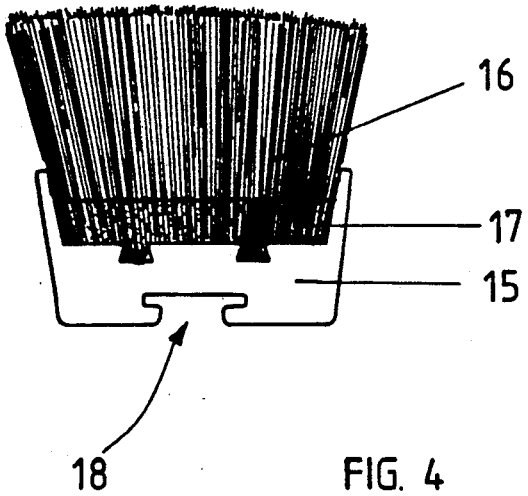
FIG. 4 illustrates an alternative embodiment of the brush element.
Figure 5:
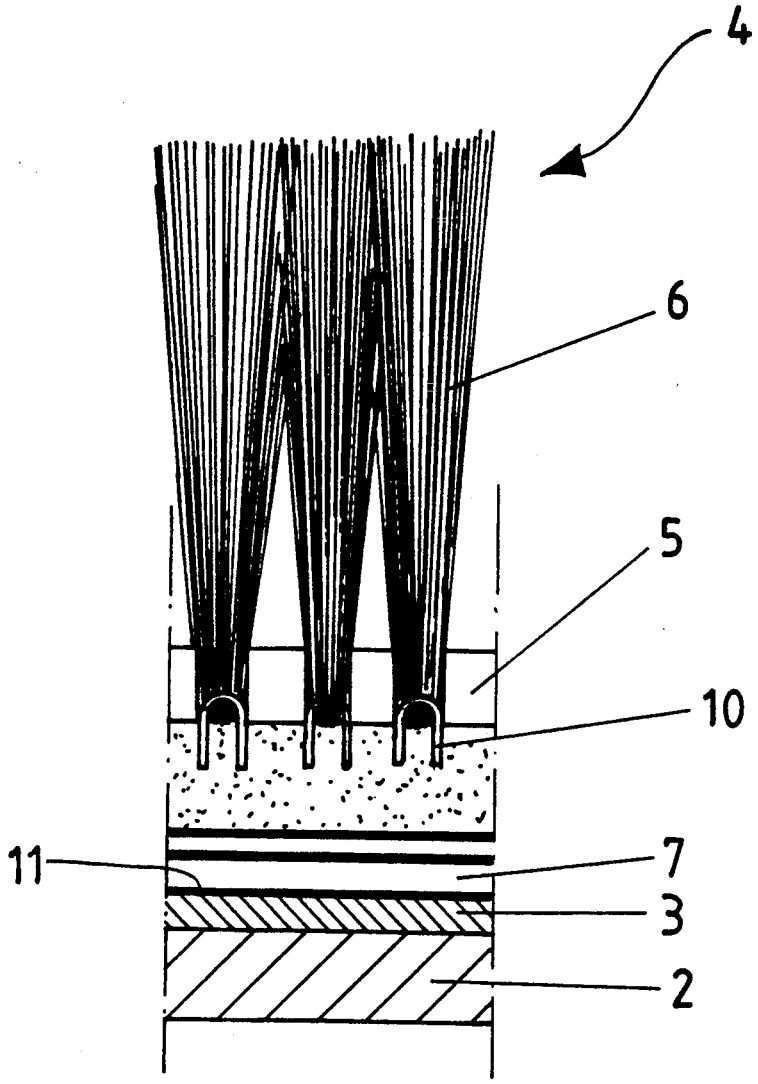
FIG. 5 is a cross-sectional view taken along line 5—5 of FIG. 3.
Figure 6A:
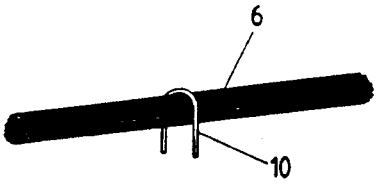
FIGS. 6*a*–6*f* illustrate the detailed construction of the brush element.
Figure 6B:
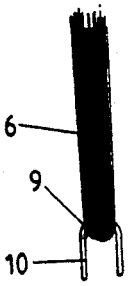
Figure 6C:
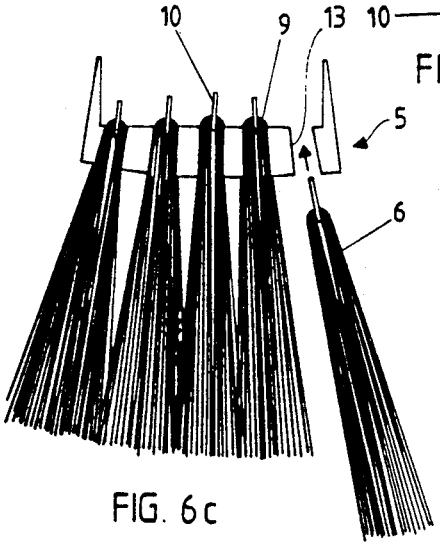
Figure 6D:
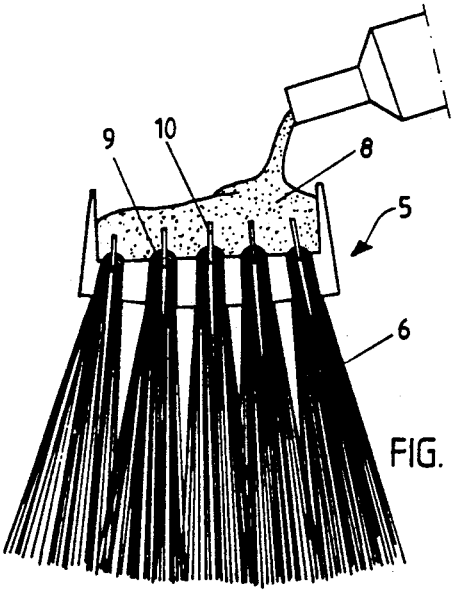
Figure 6E:
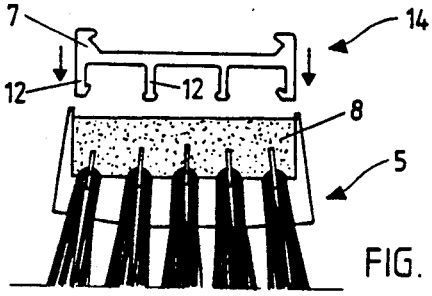
Figure 6F:
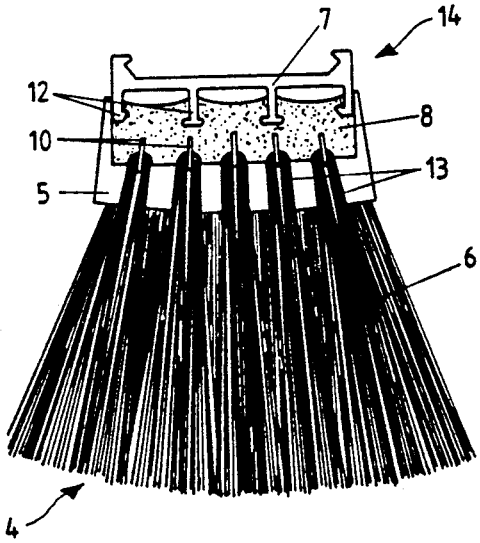

The number of brush bristles 16 in FIG. 4 can still be doubled in comparison with the previous form of construction. In this, the frame section 15 includes raised edges on the side of the bristles 16. These form vessels, into which a suitable casting mastic or other binder 17 can be poured, into which the bristles, which are presecured or compressed by a clip, are immersed.

Here, the frame section 15 includes an indentation 18 that is formed in itself, and which forms a suitable groove in the guide 3 of the brush roller 1. Correspondingly, a rail can also be machined in the cylinder itself.

While the best mode for carrying out the invention has been described in detail, those familiar with the art to which this invention relates will recognize various alternative designs and embodiments for practicing the invention as defined by the following claims.

What is claimed is:

1. A brush element intended for a brush roller, the brush roller including a raised guide of a polygonal shape on the brush roller for mounting the brush element thereon, the brush element comprising:

a frame section including a base portion and an attachment section; said base portion having a plurality of apertures therein; said base portion having outer and inner sides;

a plurality of bristles, said bristles being folded in half and defining a bent end portion and a free end portion; said bent end portion extending through said apertures from said outer side to said inner side;

a plurality of U-shaped staples, each staple being in engagement with a bunch of said plurality of said bent end portions; said staples and said bent end portions extending on said inner side of said base portion;

a cast component on the inner side of said base; said cast component adhering said bristles and U-shaped staples to said base; and said attachment section including first and second sides;

said first side including protruding grips fastenable in said cast component for attaching said base portion and said attachment section to each other;

said second side including a correspondingly polygonally shaped recess for mating contact with said raised guide to mount said frame on the brush roller.

* * * * *

UNITED STATES PATENT AND TRADEMARK OFFICE

CERTIFICATE OF CORRECTION

PATENT NO. : 5,155,875

DATED : October 20, 1992

INVENTOR(S) : Mauno Kirkkala and Reijo Kuivikko

It is certified that error appears in the above-identified patent and that said Letters Patent is hereby corrected as shown below:

Col. 1, line 46, delete "olean" and insert -- clean --.

Col. 2, line 20, after "aluminum" insert -- securing section --.

Col. 3, line 18, after "Figure 6" delete "d" and insert therefor -- b --.

Signed and Sealed this

Ninth Day of November, 1993

Bruce Lehman

*Attest:*

BRUCE LEHMAN

*Attesting Officer*

*Commissioner of Patents and Trademarks*